United States Patent [19]

Burgoon

[11] 4,429,433

[45] Feb. 7, 1984

[54] SURFACE CLEANING MACHINE WITH SQUEEGEE ASSEMBLY

[75] Inventor: Jack L. Burgoon, Toledo, Ohio

[73] Assignee: The Scott & Fetzer Company, Lakewood, Ohio

[21] Appl. No.: 412,101

[22] Filed: Aug. 27, 1982

[51] Int. Cl.[3] ..... A47L 11/16; A47L 11/202

[52] U.S. Cl. ..... 15/320; 15/50 R; 15/98; 15/366; 15/401

[58] Field of Search ..... 15/320, 50 C, 50 R, 15/366, 373, 401, 98

[56] References Cited

U.S. PATENT DOCUMENTS

| | | | |
|---|---|---|---|
| 2,969,557 | 1/1961 | Petersen | 15/320 X |
| 3,345,671 | 10/1967 | Wilson et al. | 15/320 |
| 3,866,541 | 2/1975 | O'Connor et al. | 15/320 X |
| 4,041,567 | 8/1977 | Burgoon | 15/320 |
| 4,380,844 | 4/1983 | Walderhauser et al. | 15/353 X |

*Primary Examiner*—Chris K. Moore

*Attorney, Agent, or Firm*—Allen D. Gutchess, Jr.

[57] ABSTRACT

A surface cleaning machine is provided which employs a drum broom at a forward portion of the machine for sweeping the floor, a hopper in front of the drum broom to receive debris therefrom, a plurality of disc-type scrubbing brushes at an intermediate portion of the machine for scrubbing the floor, and a squeegee assembly therebehind. A solution or supply tank and a recovery tank are located in side-by-side relationship at a forward portion of the machine, the solution tank supplying clean solution for the disc brushes and the recovery tank receiving dirty solution gathered by the squeegee assembly. The squeegee assembly is connected to the machine by arms which also raise and lower the assembly, the arms being engaged by a mounting plate carrying the disc brushes so that both the squeegee assembly and the disc brushes can be raised and lowered by common mechanism. The squeegee assembly has front and rear squeegee blades which are attached to a supporting member by clamping bands at the rear of the rear squeegee blade, the bands clamping both blades in place relative to the supporting member. The clamping arrangement requires no special attaching provisions such as fasteners and holes in the blades. The bands are quickly releaseable so that the squeegee blades can be easily and quickly removed and replaced, when necessary.

20 Claims, 6 Drawing Figures

SURFACE CLEANING MACHINE WITH SQUEEGEE ASSEMBLY

This invention relates to a machine for cleaning surfaces and specifically for sweeping and scrubbing floors.

A machine in accordance with the invention both sweeps and scrubs floors being cleaned and yet the machine is of a relatively uncomplicated and compact design. The machine preferably is of the riding type and includes a rotary drum broom near the front thereof for sweeping dirt and debris, and a plurality of staggered disc brushes at an intermediate portion of the machine behind the drum broom for scrubbing the floor. A small hopper is located in front of the rotary drum broom to receive dirt and debris therefrom. A squeegee assembly is located behind the disc brushes to pick up dirty solution from the floor, the clean solution being supplied to the disc brushes and the floor from a supply or solution tank and the dirty solution being received in a recovery tank.

The squeegee assembly is mounted on a pair of arms which are pivotally supported by the machine. A mounting plate carrying the disc brushes engages the pivoted arms when the disc brushes are raised to also cause the squeegee assembly to be raised therewith substantially simultaneously by the same mechanism. The number of components are thereby reduced, lowering costs and increasing reliability.

The squeegee assembly comprises a supporting member having a downwardly-extending, arcuate wall. A front squeegee blade extends substantially the length of the wall from one end to the other and is adjacent the rear surface of the arcuate wall. A rear squeegee blade which is substantially continuous and uninterrupted is located behind the front squeegee blade, extending the length thereof, and spacing means are located between these two blades. Clamping bands extend along the rear surface of the rear squeegee blade on the side opposite the spacing means. These bands have means located on end portions thereof for moving the clamping bands lengthwise and toward the arcuate wall so that the clamping bands hold both of the squeegee blades in position and can release both squeegee blades for ready replacement when desired.

It is therefore, a principal object of the invention to provide a compact machine for both sweeping and scrubbing floors.

Another object of the invention is to provide a surface cleaning machine with a squeegee assembly having clamping bands which hold both front and rear squeegee blades in position.

Yet another object of the invention is to provide a surface cleaning machine having a squeegee assembly and disc brushes with means for raising and lowering the squeegee assembly and disc brushes substantially simultaneously.

Many other objects and advantages of the invention will be apparent from the following detailed description of a preferred embodiment thereof, reference being made to the accompanying drawings, in which.

Figure 1:
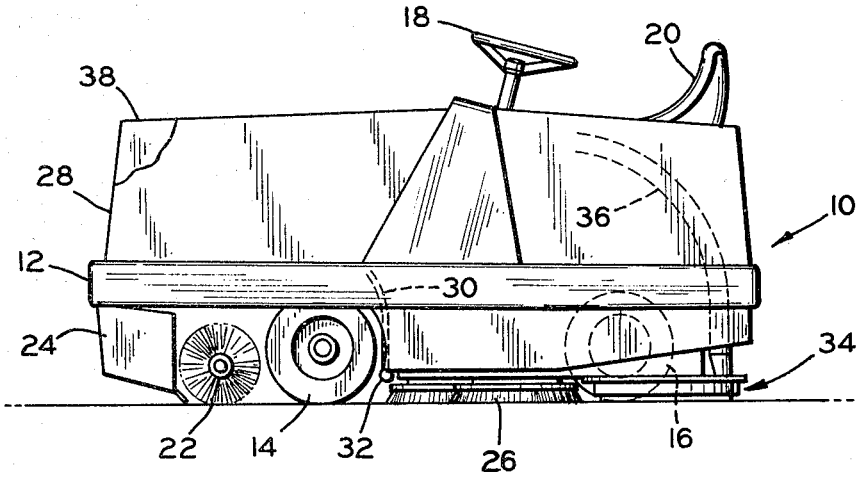
FIG. 1 is a somewhat schematic side view in elevation of a surface cleaning machine embodying the invention.

Referring to FIG. 1, a surface cleaning machine embodying the invention is indicated at 10. The machine cleans the floor by a combined scrubbing and sweeping action. It includes a body or frame 12 with forward wheels 14 and a rear wheel 16 which is steered through a steering wheel 18 located in front of an operator's seat 20.

A rotary drum broom 22 is located at a forward portion of the machine and sweeps dirt and debris from the floor into a front hopper 24 which can be removed and emptied from the front of the machine. Rotary disc brushes 26 are located behind the wheels 14 and behind the drum broom 22, being positioned in a staggered relationship so that the paths covered by the brushes slightly overlap. The path of the drum broom 22 and the combined path of the disc brushes 26 extend substantially over the width of the machine and are substantially coextensive.

Cleaning solution is supplied from a first supply or solution tank 28 at a forward portion of the machine to the floor being cleaned or to the disc brushes 26 and onto the floor through a line 30 and a distribution manifold 32 having holes spaced therealong. A substantial portion of the solution deposited on the floor is then picked up by a rear squeegee assembly 34. The dirty solution is drawn by vacuum through an exhaust hose 36 into a recovery tank 38 which is also located at the forward portion of the machine 10 in side-by-side relationship with the tank 28.

Figure 2:
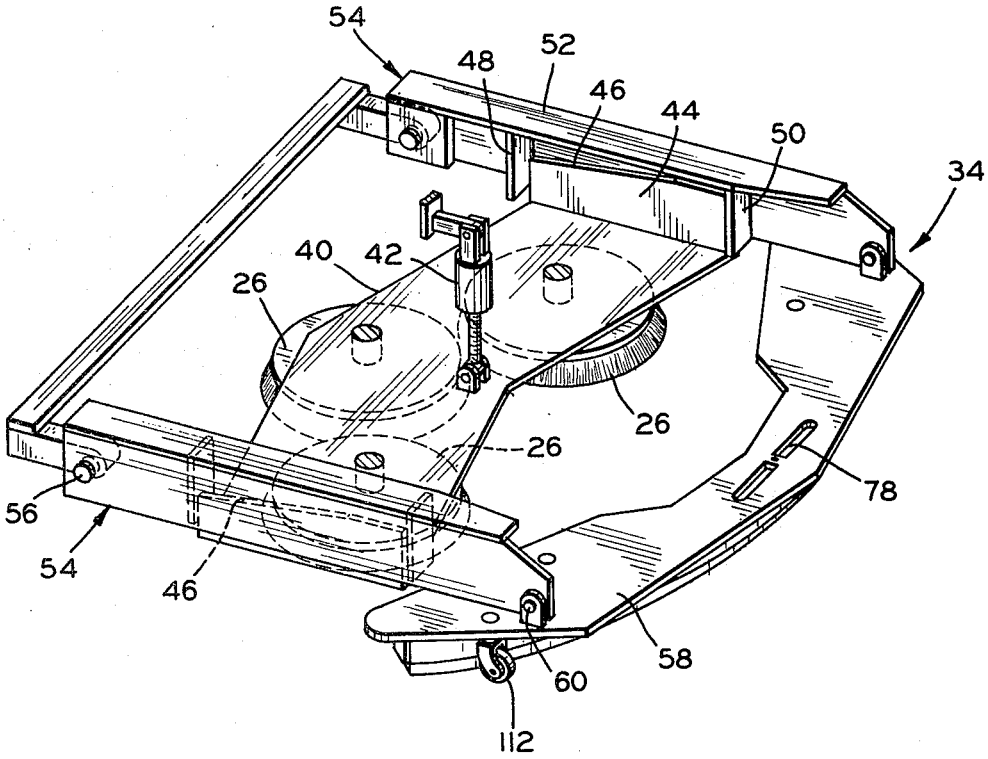
FIG. 2 is a somewhat schematic view in perspective of a disc brush assembly and a squeegee assembly of the machine with common means for raising and lowering both.
Figure 3:
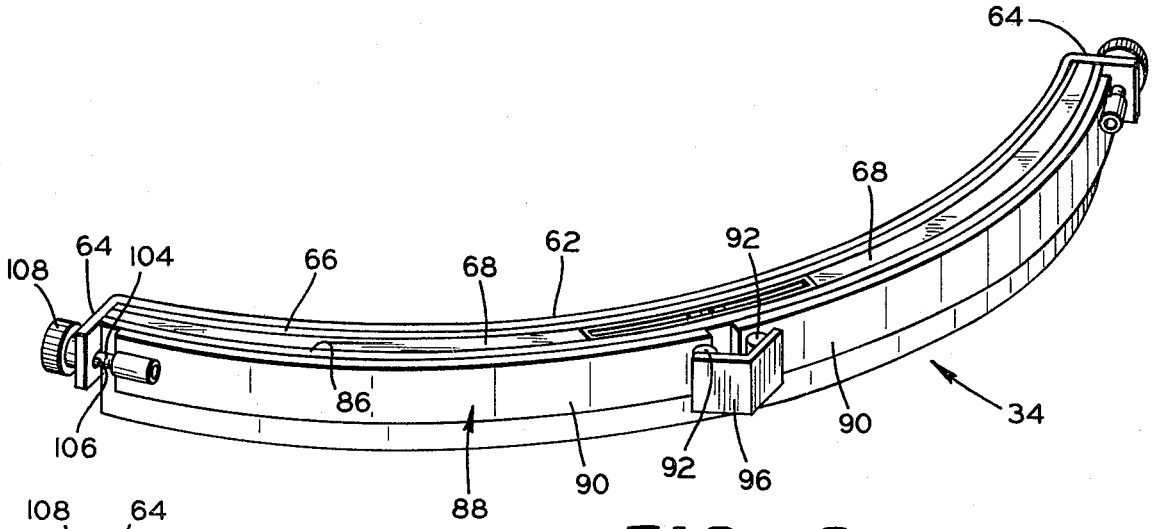
FIG. 3 is a view in perspective of part of the squeegee assembly of the machine.
Figure 4:
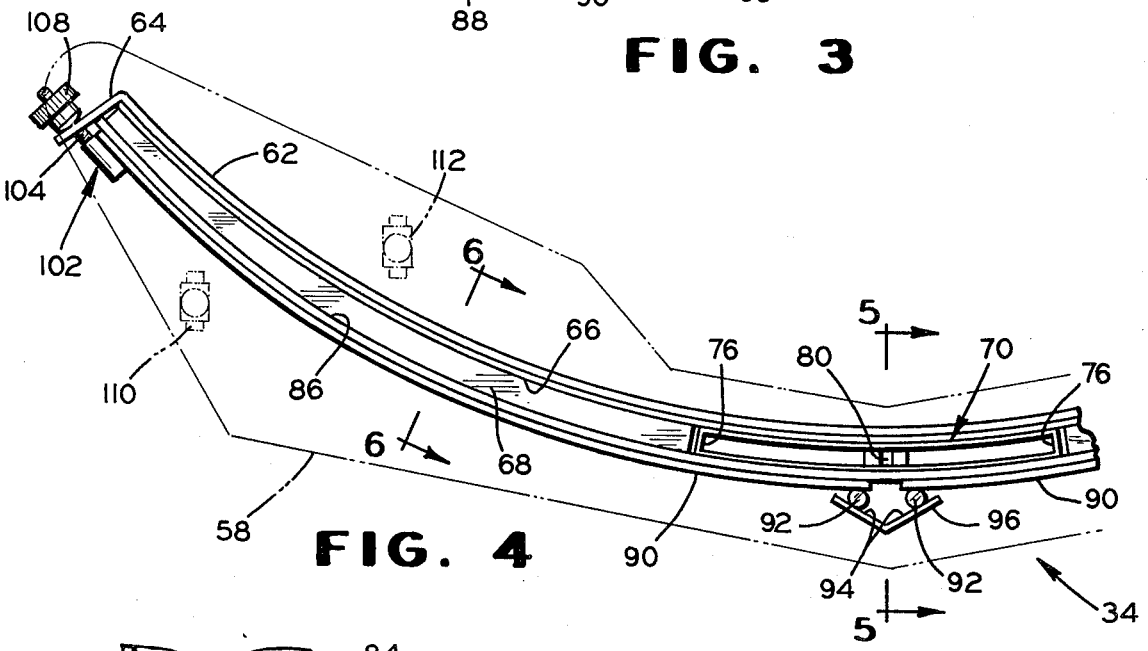
FIG. 4 is a fragmentary, enlarged top view of part of the squeegee assembly with a supporting plate shown in dotted lines.
Figure 5:
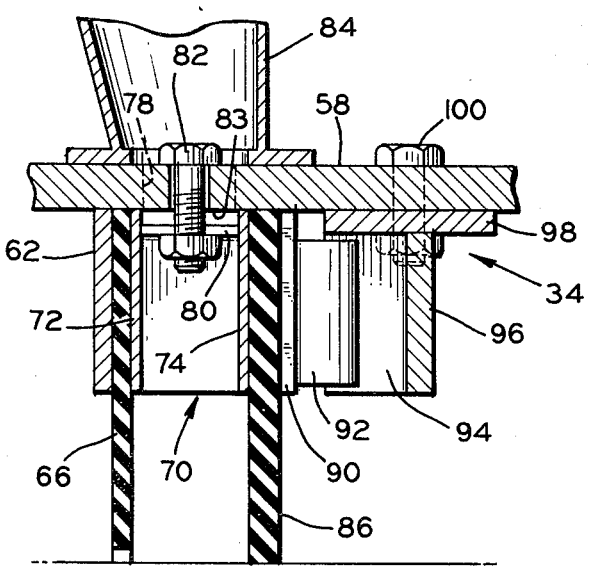
FIG. 5 is an enlarged view in transverse cross section taken along the line 5—5 of FIG. 4.
Figure 6:
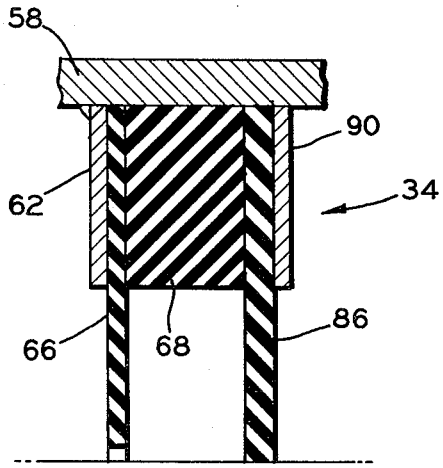
FIG. 6 is an enlarged view in transverse cross section taken along the line 6—6 of FIG. 4.

Referring to FIG. 2, the rotary disc brushes 26 are rotatably mounted below a mounting means or plate 40 with the middle brush located forwardly of the outer ones. The disc brushes 26 can be driven by individual hydraulic motors (not shown) mounted on top of the plate 40. A commercially-available linear actuator 42 is pivotally connected to the machine and pivotally connected to the plate 40 toward the rear edge thereof, with the center of gravity of the disc brushes and plate being in front of the pivotal connection of the linear actuator 42. Consequently, when the actuator is driven to raise the plate 40, it tends to tilt forwardly, tending to raise the middle brush to a lesser extent than the outer ones. The mounting plate 40 has engagable means or end flanges 44 with upper edges 46 which slant forwardly and downwardly. The flanges 44 are trapped between vertical flanges 48 and 50 and an upper horizontal flange 52 of pivotable side arms 54. This enables the mounting plate 40 and the brushes 26 to float relative to the arms 54. The arms 54, in turn, are pivotally connected to the frame of the machine 10 by pivot pins 56, with rear end portions of the arms pivotally connected to a squeegee supporting plate 58 of the squeegee assembly 34 through pivot pins 60.

With this arrangement, when the mounting plate 40 and the disc brushes 26 are raised by the linear actuator 42, the upper edges 46 of the flanges 44 engage the horizontal flanges 52 of the arms 54, causing the squeegee assembly 34 to be raised substantially simultaneously through the arms 54. As the flanges 44 engage the arms, the slanted edges 46 cause the front of the plate 40 to tilt upwardly, thereby raising the middle disc brush 26.

Referring more particularly to FIGS. 3–6, the squeegee assembly 34 has a downwardly-depending wall or flange 62 preferably of arcuate shape and terminating in turned-out end flanges 64. A front squeegee blade 66 is contiguous with the rear surface of the wall 62 and extends substantially the length thereof, from one end to the other. To the rear of the blade 66 are spacers 68 which are preferably in the form of elongate, tapered rubber blocks which extend from the outer ends of the front squeegee blade 66 toward but stopping short of the center thereof. An exhaust housing 70 is located between the ends of the spacers 68, having an arcuate front wall 72 contiguous with the front blade 66, and having an arcuate rear wall 74 with end walls 76 terminating adjacent the inner ends of the spacers 68. The exhaust housing 70 also communicates with an exhaust slot 78 (FIG. 2) in the supporting plate 58 and has a cross slot 80 through which a fastener 82 extends. The fastener 82 also extends through a hole in a web 83 (FIG. 5) located across the slot 78 to connect the housing 70 to the supporting plate 58 so that the housing has a certain amount of limited pivotal movement and movement toward and away from the wall 62. An exhaust hose fitting 84 is fastened to the upper surface of the supporting plate 58 around the slot 78 and receives the exhaust hose 36, as is known in the art.

A rear squeegee blade 86, which is slightly thicker than the front blade 66, extends substantially the length of the front blade 66 and is contiguous with the rear surfaces of the spacers 66 and with the rear wall 74 of the exhaust housing 70. The exhaust housing 70 communicates with the space between the blades 66 and 86 to form a negative pressure chamber extending the length of the blades.

Both of the front and rear squeegee blades 66 and 86 are clamped in position by clamping band means indicated at 88. As shown, the clamping band means 88 includes two clamping bands 90 which extend from outer, forward ends of the squeegee blades to a central portion thereof. The inner ends of the bands 90 have pin means or rods 92 affixed thereto which engage slanted surfaces 94 of a V-shaped cam member 96 which depends from a bracket 98 (FIG. 5) affixed to the supporting plate 58 by fasteners 100. The cam member 96 is adjustable relative to the supporting plate 58 for movement toward and away from the depending flange 62. When the clamping bands 90 move lengthwise away from one another at the central portion of the blades, the rods 92 are cammed inwardly by the slanted surfaces 94 of the cam member 96 to urge the clamping bands against the rear blade 86.

Engageable means indicated at 102 are located at the outer ends of the clamping bands 90 to move the bands 90 lengthwise to clamp the blades in place. As shown, the engageable means 102 include threaded shanks 104 affixed to end portions of the bands 90 and extending therebeyond. The shanks 104 extend through openings 106 in the end flanges 64 and are threaded into suitable hand knobs 108. When the knobs 108 are turned further onto the shanks 104, they move the bands 90 lengthwise toward the outer ends and urge the bands 90 against the rear squeegee blade 86. This, in turn, is clamped against the exhaust housing 70 and the spacers 68 which are urged against the front squeegee blade 66 to clamp it against the rear surface of the depending wall 62. Thus, from the above, it will be seen that the single clamping band means clamps both the front and rear squeegee blades in place for easy removal and replacement.

Suitable casters 110 and 112 are located on both sides of the squeegee blades to provide full support for the assembly.

Various modifications of the above-described embodiment of the invention will be apparent to those skilled in the art, and it is to be understood that such modifications can be made without departing from the scope of the invention, if they are within the spirit and the tenor of the accompanying claims.

I claim:

1. A surface cleaning machine comprising a frame, wheel means for supporting said frame above the surface, a cleaning solution tank carried by said frame, a recovery tank carried by said frame, a plurality of scrubbing disc brushes for scrubbing the surface with cleaning solution from said cleaning solution tank, mounting means for said disc brushes, a squeegee assembly located behind said disc brushes for collecting cleaning solution deposited on the surface, exhaust means communicating with said squeegee assembly and with said recovery tank for supplying solution from said squeegee assembly to said recovery tank, lifting means for substantially simultaneously raising and lowering said disc brushes and said squeegee assembly, said squeegee assembly having a squeegee supporting member connected to said lifting means, said squeegee supporting member having a downwardly-extending wall, a front squeegee blade adjacent said wall, a rear squeegee blade, spacing means between said front and rear squeegee blades, clamping band means extending along the rear squeegee blade on the side opposite said spacing means, and means engagable with at least an end portion of said clamping band means for moving said clamping band means lengthwise and toward said downwardly-extending wall to hold said front and rear squeegee blades in position relative to said wall and said supporting member.

2. A surface cleaning machine according to claim 1 characterized by a drum brush being mounted below said frame at a forward portion thereof for contacting the surface and for removing debris therefrom, and a hopper removably mounted forwardly of said drum brush on said frame for receiving debris from said drum brush.

3. A surface cleaning machine according to claim 1 characterized by said lifting means beginning to raise said disc brushes before raising said squeegee assembly.

4. A surface cleaning machine according to claim 1 characterized by said lifting means comprising pivoted arms pivotally supported by said frame and pivotally connected to said squeegee supporting member, and said mounting means being engagable with said arms.

5. A surface cleaning machine according to claim 4 characterized by said lifting means including power means connected to said mounting means for raising and lowering said mounting means.

6. A surface cleaning machine according to claim 1 characterized by said downwardly-extending wall being of arcuate shape and said clamping band means comprising two separate clamping bands, each having said engagable means at an end portion thereof near forward, outer end portions of said squeegee blades.

7. A surface cleaning machine according to claim 6 characterized by said clamping bands having inner end portions terminating near central portions of said squeegee blades, and means engagable with said inner end portions to urge said clamping bands toward said arcuate wall when said clamping bands are moved lengthwise by said engagable means.

8. A surface cleaning machine for cleaning surfaces comprising a frame, wheel means for supporting said frame above the surface, a cleaning solution tank carried by said frame at a forward portion thereof, a recovery tank carried by said frame in side-by-side relationship with respect to said cleaning solution tank, a drum brush mounted below said frame at a forward portion thereof for contacting the surface and for removing debris therefrom, a hopper removably mounted forwardly of said drum brush on said frame for receiving debris from said drum brush, a plurality of scrubbing disc brushes for scrubbing the surface with cleaning solution from said cleaning solution tank after the debris is removed by said drum brush, mounting means for said disc brushes located behind said drum brush, a squeegee assembly located behind said disc brushes for collecting cleaning solution deposited on the surface, exhaust means communicating with said squeegee assembly and with said recovery tank for supplying solution from said squeegee assembly to said recovery tank, and lifting means, including means engagable between said disc brush mounting means and said squeegee assembly, for substantially simultaneously raising and lowering said disc brushes and said squeegee assembly.

9. A surface cleaning machine according to claim 8 characterized by said lifting means beginning to raise said disc brushes before raising said squeegee assembly.

10. A surface cleaning machine according to claim 8 characterized by said lifting means comprising pivoted arms pivotally supported by said frame and pivotally connected to said squeegee supporting member, and said mounting means being engagable with said arms.

11. A surface cleaning machine according to claim 10 characterized by said lifting means including power means connected to said mounting means for raising and lowering said mounting means.

12. A surface cleaning machine according to claim 8 characterized by said squeegee assembly comprising a squeegee supporting member having a downwardly-extending wall, a front squeegee blade adjacent said wall, a rear squeegee blade, spacing means between said front and rear squeegee blades, clamping band means extending along the rear squeegee blade on the side opposite said spacing means, and means engagable with at least an end portion of said clamping band means for moving said clamping band means lengthwise and toward said downwardly-extending wall to hold said front and rear squeegee blades in position relative to said wall and said supporting member.

13. A surface cleaning machine according to claim 12 characterized by said downwardly-extending wall being of arcuate shape and said clamping band means comprising two separate clamping bands, each having said engagable means at an end portion thereof near forward, outer end portions of said squeegee blades.

14. A surface cleaning machine according to claim 13 characterized by said clamping bands having inner end portions terminating near central portions of said squeegee blades, and means engagable with said inner end portions to urge said clamping bands toward said arcuate wall when said clamping bands are moved lengthwise by said engagable means.

15. A squeegee assembly for a surface cleaning machine comprising a squeegee supporting member, means for connecting said squeegee supporting member to said machine, said squeegee supporting member having a downwardly-extending, arcuate wall, a front squeegee blade extending substantially the length of said wall from one end to another, a rear squeegee blade extending substantially the length of said front squeegee blade from one end to another, elongate spacing means between said front and rear squeegee blades, clamping band means extending along the rear squeegee blade on the side opposite said spacing means, and means engagable with at least an end portion of said clamping band means near at least one forward, outer end portion of said squeegee blades for moving said clamping band means lengthwise and toward said arcuate wall, whereby said clamping band means holds said rear squeegee blade against said spacing means which holds said forward squeegee blade against said arcuate wall when said clamping band means is so moved by said engagable means.

16. A squeegee assembly according to claim 15 characterized by said clamping band means comprising two separate clamping bands, each having said engagable means at an end portion thereof near the forward, outer end portions of said squeegee blades.

17. A squeegee assembly according to claim 16 characterized by said clamping bands having inner end portions terminating near central portions of said squeegee blades, and means engagable with said inner end portions to urge said clamping bands toward said arcuate wall when said clamping bands are moved lengthwise by said engagable means.

18. A squeegee assembly according to claim 15 characterized by said spacing means comprising two elongate resilient members tapering in a direction toward the outer end portions of said squeegee blades.

19. A squeegee assembly according to claim 15 characterized by there being two of said spacing means, and an exhaust housing located between said two spacing means and communicating with a slot in said supporting member, both of said squeegee blades extending downwardly below said spacing means and said exhaust housing.

20. A squeegee assembly according to claim 19 characterized by said exhaust housing being fastened to said squeegee supporting member for movement toward and away from said arcuate wall.

* * * * *